US005985502A

United States Patent [19]

Ayaki et al.

[11] Patent Number: 5,985,502

[45] Date of Patent: Nov. 16, 1999

[54] TONER FOR DEVELOPING AN ELECTROSTATIC IMAGE AND PROCESS FOR PRODUCING A TONER

[75] Inventors: Yasukazu Ayaki, Numazu; Takeshi Ikeda, Kawasaki; Tetsuro Fukui, Yokohama; Yoshinobu Baba, Yokohama; Hitoshi Itabashi, Yokohama, all of Japan

[73] Assignee: Canon Kabushiki Kaisha, Tokyo, Japan

[21] Appl. No.: 08/994,030

[22] Filed: Dec. 18, 1997

[30] Foreign Application Priority Data

Dec. 20, 1996 [JP] Japan ..... 8-340760

[51] Int. Cl.[6] ..... G03G 9/087

[52] U.S. Cl. ..... 430/109; 430/111; 430/137

[58] Field of Search ..... 430/109, 137, 430/111

[56] References Cited

U.S. PATENT DOCUMENTS

| | | | |
|---|---|---|---|
| 2,297,691 | 10/1942 | Carlson | 95/5 |
| 5,470,687 | 11/1995 | Mayama et al. | 430/137 |
| 5,744,278 | 4/1998 | Ayaki et al. | 430/110 |

FOREIGN PATENT DOCUMENTS

| | | |
|---|---|---|
| 42-23910 | 11/1967 | Japan . |
| 43-24748 | 10/1968 | Japan . |
| 5-93002 | 4/1993 | Japan . |
| 6-52432 | 7/1994 | Japan . |

*Primary Examiner*—Christopher D. Rodee
*Attorney, Agent, or Firm*—Fitzpatrick, Cella, Harper & Scinto

[57] ABSTRACT

A toner has at least 100 parts by weight of binder resin and 0.1 to 15 parts by weight of colorant. The toner has a number average particle size (Dn) of 0.5 to 6.0 $\mu$m, a particle size distribution coefficient (volume average particle size (Dv) / number average particle size (Dn)) of 1.0 to 1.3 and a variation coefficient of particle number distribution of 20% or less.

The toner contains 0.1 to 5.0% by weight of methanol-soluble resin component extracted by the first Soxhlet extraction with methanol and 50 to 99% by weight of THF-soluble resin component extracted by a second Soxhlet extraction with tetrahydrofuran (THF) after the Soxhlet extraction with methanol, wherein the maximum glass transition point ($Tg_2$) of the methanol-soluble resin component and the glass transition point ($Tg_1$) of the THF-soluble resin component satisfies the following relation;

$$0\ (^\circ\ C.) < Tg_2 - Tg_1 \leq 150\ (^\circ\ C.)$$

and $$50\ (^\circ\ C.) \leq Tg_1.$$

40 Claims, 3 Drawing Sheets

TONER FOR DEVELOPING AN ELECTROSTATIC IMAGE AND PROCESS FOR PRODUCING A TONER

BACKGROUND OF THE INVENTION

1. Field of the Invention

The present invention relates to a toner for developing electrostatic latent images used for forming electophotographic positive images from electrostatic latent images, and a process for producing the toner.

2. Description of the Related Art

Various methods for electrophotography are known in the art as described in U.S. Pat. No. 2,297,691, Japanese Patent Publication No. 42-23910 and Japanese Patent Publication No. 43-24748. The electrophotographic images are usually fixed by heat, pressure or heat and pressure, or by exposing to a solvent vapor to obtain a copied article or printed matter after forming an electric latent image on a photosensitive material by a variety of methods using a photoconductive substance, developing the latent image with a toner, and transferring the toner image on a transfer material such as paper using a direct or indirect method depending on the requirement. The toner that is not transferred and left on the photosensitve material is cleaned off by various conventional cleaning methods if necessary, repeating the steps described above thereafter.

The toner as described above is usually composed of particles comprising a binder resin and colorant as main components and contains, if necessary, a charge control agent and external additive for fixing. The particle size is usually in the range of several to 20 or 30 microns. This toner is usually produced by a so-called crushing method in which colorants such as dyes, pigments or magnetic members are mixed with a thermoplastic resin and the resin is fused to uniformly disperse the colorants in the thermoplastic resin, followed by crushing of the resin and classification of crushed particles.

Recently, an image forming device using electrophotography has been widely used simply not only as a office copy machine to copy written manuscripts but also for the purposes of full color copying providing a high quality of images and high precision output for computers. Printers are now also used for personal computers as computers have come into wide use. In accordance with this trend, lowering the fixing temperature become required for the purpose of saving electric power.

Accordingly, a higher performance of the toner has been required because the requirement to form excellent images can not be attained provided that improvements in performance such as image quality and fixing ability of the toner are not satisfied.

One measure for attaining a high quality image is to make the particle size of the toner small. Improvements in the image quality and image resolution have been actually performed by making the particle size as small as several microns. However, it is difficult to make the particle size as small as 5 to 6 microns or less by the conventional crushing method since crushed debris adheres to the crushing device due to the strong impact required to make the particles as small as possible. Moreover, only a limited degree of sharpness of the particle size distribution is attained by classification of the particles due to the presence of a cohesive force caused by finely grinding the particles. As a result, controlling the electrostatic charge of the toner is difficult, thereby causing undesired scattering and fogging of images.

Toner produced by a polymerization process has been proposed to provide reduced size toner particles or to obtain a sharp particle size distribution. For example, methods for producing particles having a sharp particle size distribution in the range of 1 to 10 $\mu$m are disclosed in Japanese Patent Publication No. 6-52432 and Japanese Patent Laid-Open No. 5-93002.

Although such particles having a sharp particle size distribution are excellent in fluidity, there exists another problem in that the toner tends to coagulate or agglomerate when forming close packing or, especially, when exposed to high temperatures. Once the toner or developer has agglomerated, incomplete charging is liable to occur, which leads to poor resolution of developed images.

This leaves significant problems when the glass transition point and mean molecular weight of adhesive resins are decreased so as to make finer toner particles or to lower the fixing temperature.

SUMMARY OF THE INVENTION

Accordingly, it is an object of the present invention to provide a toner for developing an electrostatic image having a fine particle size and narrow particle size distribution to provide a high image quality as well as low temperature fixing, and a process for producing the toner.

Another object of the present invention is to provide a toner for developing an electrostatic image that does not cause agglomeration of the toner and developer even when they are allowed to stand at high temperatures, wherein the toner has a good fluidity and is easily charged to obtain a high quality image.

Another object of the present invention is to provide a toner for developing an electrostatic image comprising:

at least 100 parts by weight of a binder resin and 0.1 to 15 parts by weight of a colorant, wherein said toner has a number average particle size (Dn) of 0.5 to 6.0 $\mu$m, a particle size distribution coefficient ratio of (volume average particle size (Dv) /number average particle size (Dn)) of 1.0 to 1.3 and a variation coefficient of particle number distribution of 20% or less, said toner contains 0.1 to 5.0% by weight of methanol-soluble resin component extracted by a first Soxhlet extraction with methanol and 50 to 99% by weight of THF-soluble resin component extracted by a second Soxhlet extraction with THF after the first Soxhlet extraction with methanol, and a highest glass transition point ($Tg_2$) of the methanol-soluble resin component and a maximum glass transition point ($Tg_1$) of the THF-soluble resin component satisfying the following relation:

$$0\ (^\circ\ C.) < Tg_2 - Tg_1 \leq 150\ (^\circ\ C.)$$

and $$50\ (^\circ\ C.) \leq Tg_1.$$

Another object of the present invention is to provide a process for producing a toner comprising the steps of:

dissolving (i) a polymerizable monomer soluble in a polymerization solvent and (ii) a polymer composition soluble in the polymerization solvent to form a polymerization reaction system, wherein the polymerization solvent comprises a mixed polymerization solvent containing at least water and 30.0 to 99.9% by weight, based on the weight of the mixed polymerization solvent, of methanol, ethanol or a mixture thereof;

polymerizing the polymerizable monomer in the polymerization system to form polymerized particles; and washing the polymerized particles with an washing solvent, wherein the washing solvent comprises a mixed washing solvent containing at least water and at least 30% by weight, based on the mixed washing solvent, of saturated alcohols represented by the following formula (1):

$$C_nH_{2n+1}OH \quad (1)$$

wherein n in the formula denotes an integer of 1 to 5; and forming a toner from the washed polymerized particles, wherein the toner comprises at least 100 parts by weight of a binder resin and 0.1 to 15 parts by weight of a colorant, the toner having a number average particle size (Dn) of 0.5 to 6.0 μm, a particle size distribution coefficient ratio of (volume average particle size (Dv) /number average particle size (Dn)) of 1.0 to 1.3 and a variation coefficient of particle number distribution of 20% or less, the toner contains 0.1 to 5.0% by weight of methanol-soluble resin component extracted by a first Soxhlet extraction with methanol and 50 to 99% by weight of THF-soluble resin component by a second Soxhlet extraction with THF after the first Soxhlet extraction with methanol, and a highest glass transition point ($Tg_2$) of the methanol-soluble resin component and a maximum glass transition point ($Tg_1$) of the THF-soluble resin component satisfying the following relation:

$$0\ (^\circ\ C.) < Tg_2 - Tg_1 \leqq 150\ (^\circ\ C.)$$

and $$50\ (^\circ\ C.) \leqq Tg_1.$$

DESCRIPTION OF THE PREFERRED EMBODIMENTS

Figure 1:
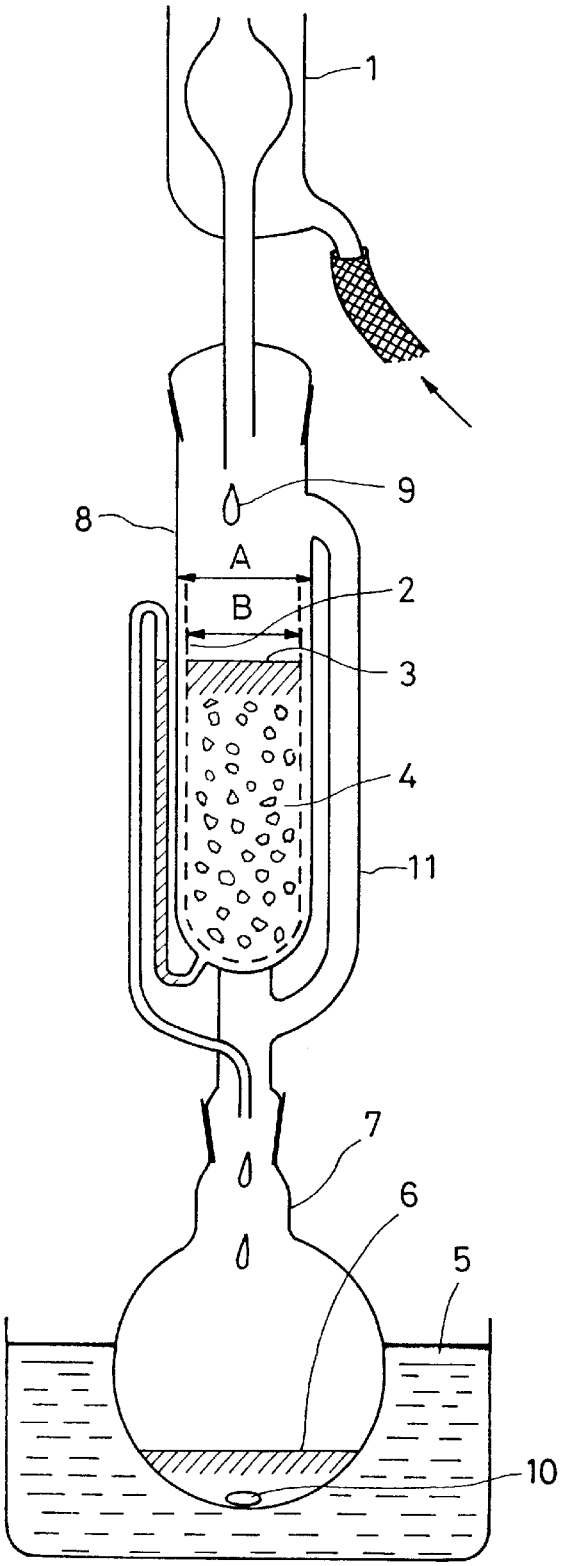
FIG. 1 is an illustrative drawing of the Soxhlet extractor used in the present invention.

One aspect of the present invention is that the toner for developing electrostatic images has a number average particle size of 0.5 to 6.0 μm, a particle size distribution coefficient (Dv/Dn) of 1.0 to 1.3 and a particle number variation coefficient of 20% or less.

According to a detailed investigation by the inventors, toners having a fine particle size of 0.5 to 6.0 μm permit accurate development of latent images. It was also found that a particle size distribution coefficient (Dv/Dn) of 1.0 to 1.3 and a particle number variation coefficient of 20% or less are required for suppressing fluctuation of electric charge in the toner having a fine particle size.

For the purpose of preventing such toner having a fine and uniform particle size from being packed by electrostatic charge and from agglomerating, it was found effective to provide (i) 0.1 to 5.0% by weight of a methanol-soluble resin component extracted by a first Soxhlet extraction with methanol and (ii) 50 to 90% by weight of a THF-soluble resin component extracted by a second Soxhlet extraction after eliminating the methanol-soluble resin component in the vicinity of the toner surface.

The methanol-soluble component contains the polymer composition used in producing the toner, a small amount of low molecular weight component in the toner binder resin, an initiator and other additives.

In the present invention, when the content of the methanol-soluble resin component is less than 0.1% by weight, the toner surface is not sufficiently modified to prevent agglomeration. When the content exceeds 5.0% by weight, the toner has poor fixability, although the agglomeration preventing effect is favorably exhibited owing to a high glass transition point of such methanol-soluble resin component.

While the fixability is good when the highest glass transition point ($Tg_2$) of the methanol-soluble resin component is less than the maximum glass transition point ($Tg_1$) of the THF-soluble resin component extracted by the second Soxhlet extraction with THF after the first Soxhlet extraction with methanol, the tendency to agglomerate at high temperatures is much worse. Accordingly, the highest glass transition point ($Tg_2$) of the methanol-soluble resin component is also important. By making $Tg_2$ higher than the maximum glass transition point ($Tg_1$) of the THF-soluble resin component, the surface of the toner particles is made sufficiently rigid by the component containing 0.1 to 5.0% by weight of the methanol-soluble resin component such that mutual agglomeration of the toner particles is prevented and the fixability of the toner is improved.

However, because the proportion of the methanol-soluble resin component that constitutes the surface layer of the toner particles is low and the surface layer of the toner particles is a thin film, it is important that the maximum glass transition point ($Tg_1$) of the THF-soluble resin component that occupies the inner portion of the toner particles is 50° C. or more, even when the surface of the toner particles is more rigid.

In the toner of the present invention, the molecular weight distribution of the polystyrene converted molecular weight of the THF-soluble resin component contained in the toner has a molecular weight peak in the molecular weight range of 20,000 to 100,000 as determined by GPC and the content of the component with a molecular weight of 200 to 1,000 is 3% by weight or less. This means that, although the toner according to this invention has a relatively low molecular weight, agglomeration of the toner is prevented while fixing at a low temperature is made possible by suppressing the content of the very low molecular weight component with a molecular weight of 200 to 1000, to 3% by weight or less.

Though the toner according to this invention can be produced by a method known to the art, it is preferable to directly produce the toner by the polymerization process. The toner is more preferably produced by the steps comprising:

dissolving (i) a polymerizable monomer composition soluble in the polymerization solvent and (ii) a polymer composition soluble in the polymerization solvent, to prepare a polymerization reaction system;

polymerizing the polymerizable monomer composition in the polymerization reaction system to form polymerized particles;

washing the polymerized particles an washing solvent; and forming a toner from the washed polymerized particles.

It is preferable that, in the production process, the polymerization solvent contains at least water and 30 to 99.9% by weight, based on the mixed polymerization solvent, of methanol, ethanol or a mixture thereof;

wherein the washing solvent contains at least water and at leasr 30% by weight, based on the mixed washing solvent, of saturated alcohols represented by the following formula (1):

$$C_nH_{2n+1}OH \quad (1)$$

wherein n is an integer of 1 to 5.

It is also preferable, in the present invention, that the washing solvent used in the washing step contains 0.1 to 70.0% by weight, preferably 0.5 to 65.0% by weight, of water. It is more preferable that a second washing step where the particles are washed with water after the washing step described above is conducted as an additional washing step.

A desired amount of the polymer composition should be left on the toner surface. The molecular weight distribution peak can be adjusted to a relatively low molecular weight range to reduce the content of any very low molecular weight component with a molecular weight of 200 to 1000 to be as small as possible. Agglomeration of the toner at high temperatures is also inhibited and the low temperature fixability is improved. These features are provided by employing 30 to 99.9% by weight of methanol, ethanol or a mixture in the polymerization solvent, and by utilizing 0.1 to 70.0% by weight of water in the washing solvent.

The polymer composition is allowed to be advantageously present on the toner surface by a plurality of washing steps with a mixed solvent containing 30% by weight of the saturated alcohol designated by the foregoing formula (1) in the washing step. It is preferable that the mixed washing solvent has the same solubility as the mixed polymerization solvent or is a poor solvent compared with the mixed polymerization solvent to be used in polymerization. It is preferable that the final washing is carried out with water to modify the surface as described previously.

The construction of the present invention will be described in more detail hereinafter.

It is essential that the number average particle size (Dn) is 0.5 to 6.0 $\mu$m, preferably 1.0 to 5.0 $\mu$m to obtain a highly precise image. When Dn is 0.5 $\mu$m or less, handling the toner as a dry powder becomes difficult while, when Dn exceeds 6.0 $\mu$m, an accurate development of tiny dot latent images becomes so difficult that reproducibility of highlights is reduced.

The value of the particle size distribution coefficient (Dv/Dn)—that is; a ratio of the volume average particle size (Dv) to number average particle size (Dn) is preferably 1.0 to 1.3 with the value of 1.0 to 1.2 being more preferable. It is preferable that the variation coefficient of the particle number distribution is 20% or less and a variation coefficient of 18% or less is more preferable.

Variation coefficient (%) (standard deviation of particle number distribution / number average particle size)×100

The particle size distribution described above is necessary since, in addition to the mean particle size, the divergence of the particle size distribution particularly contributes to the reproducibility of the image in the transfer process. In other words, when (Dv/Dn) is more than 1.3 or variation coefficient is more than 20% while the number average particle size (Dn) is within the range of the present invention, reproducibility of the half-tone images is reduced owing to scattering of the toner or the presence of the non-transferred toner and good image development occurs.

It is important in the present invention that the toner surface according to the present invention contains 0.1 to 5.0% by weight, preferably 0.2 to 4.0% by weight and more preferably 0.5 to 2.0% by weight of the methanol-soluble resin component. When the content of the methanol-soluble resin component is less than 0.1% by weight, agglomeration resistance at high temperature is unsatisfactory while, when the content is more than 5.0% by weight, fixability is deteriorated since the resin has a high Tg value.

It is preferable that the toner contains 50 to 99% by weight, preferably 60 to 99% by weight and more preferably 70 to 95% by weight of the THF-soluble resin component (the component obtained by a Soxhlet extraction with THF) which remains after the Soxhlet extraction of the methanol-soluble resin component. When the content of the THF-soluble resin component after eliminating the methanol-soluble resin component in the toner is less than 50% by weight, the toner will have insufficient amount of the component having a molecular weight sufficient to properly fix the toner to obtain a good fixed image. When the content is more than 99% by weight, there are some problems in coloring, fixing and charging due to insufficient amount of the colorant, other additives and the gel component of the resin.

It is preferable that the highest transition temperature ($Tg_2$) of the methanol-soluble resin component and the maximum transition temperature ($Tg_1$) of the THF-soluble resin component satisfies the following relation:

$$0\ (^\circ\ C.) < Tg_2 - Tg_1 \leqq 150\ (^\circ\ C.)$$

and $$50 (^\circ\ C.) \leqq Tg_1$$

where $Tg_2$ is the highest transition temperature of the methanol-soluble resin component and $Tg_1$ is the maximum transition temperature of the THF-soluble resin component.

It is necessary to provide satisfactory low temperature fixability and agglomeration resistance that the relation between $Tg_1$ and $Tg_2$ is preferably 10 (° C.)<$Tg_2-Tg_1 \leqq 100$ (° C.), and more preferably 20 (° C.)<$Tg_2-Tg_1 \leqq 80$ (° C.). When $Tg_2-Tg_1$ is 0° C. or a negative value, agglomeration resistance can not be fully satisfied even when the amount of the methanol-soluble resin component on the toner particle surface is within the previously described range. When $Tg_2-Tg_1$ exceeds 150° C., the low temperature fixability may not be fully satisfied.

A temperature of 50° C. or more, preferably 50 to 80° C. and more preferably 55 to 70° C., is required for $Tg_1$ in the present invention. A more preferable temperature is 55 to 70° C. When $Tg_1$ is lower than 50° C., agglomeration may not be advantageously prevented because, no matter how rigid the surface of the toner, the toner becomes coated with a thin film. When $Tg_1$ is too high, the low temperature fixability is decreased.

The term "methanol-soluble component" in the present invention refers to the component extracted by using a Soxhlet extractor as shown in FIG. 1 after dispersing a prescribed amount of monomer in methanol.

The term "THF-soluble component extracted by Soxhlet extraction with THF after Soxhlet extraction with methanol"

refers to the component that is further extracted from the methanol-insoluble component after the Soxhlet extraction with methanol by Soxhlet extraction with THF.

In the toner according to the present invention, the polystyrene-converted molecular weight distribution of the THF-soluble resin component measured by GPC has a molecular weight peak in the molecular weight range of 2,000 to 100,000. The content of the component with a molecular weight of 200 to 1,000 is advantageously 3% by weight or less and the content of 1% by weight is preferable. The component that satisfies this condition more effectively improves the blocking resistance and agglomeration resistance, as well as the low temperature fixability.

When the molecular weight peak is less than 2,000, the toner is liable to agglomerate. When the molecular weight peak is greater than 100,000, the fixing temperature tends to be increased although packing due to agglomeration can be prevented. Further, when the content of the component with a molecular weight of 200 to 1,000 exceeds 3% by weight, it is difficult to effectively prevent agglomeration due to packing, especially at a higher temperature.

It is preferable that the methanol-soluble resin component of the toner used in the present invention contains polar groups in the molecule. The resin having polar groups has an affinity to the mixed polymerization solvents comprising methanol and/or ethanol, so that the resin can stably exist on the toner surface in the preferable production process according to the present invention. This feature permits a toner having a sharp particle size distribution according to the present invention to be more stabilized in addition to enhancing agglomeration resistance at a high temperature.

Examples of typical polar groups are hydroxyl, carboxyl, ester, amide, ether and sulfonic acid groups.

A preferable production process according to the present invention will be described hereinafter.

The toner according to the present invention preferably contains toner particles directly obtained by polymerizing the polymerizable monomers in the polymerization solvents. It is especially preferable that the polymer soluble in the polymerization solvent and formed by the polymerization reaction is produced by the following steps:

dissolving (i) a polymerizable monomer composition being soluble in a polymerization solvent and (ii) a polymer composition soluble in said polymerization solvent, to prepare a polymerization reaction system;

polymerizing the polymerizable monomer composition in the polymerization reaction system to form polymerized particles;

washing the polymerized particles obtained by the polymerization reaction with a washing solvent; and forming a toner from the polymerized particles after washing.

The methanol-soluble resin composition according to this invention contains the polymer composition soluble in the polymerization solvent described above. Examples of the polymer composition are polystyrene derivatives such as polyhydroxystyrene, polystyrene sulfonic acid, vinylphenol-(meth)acrylic acid ester copolymer and styrene-vinylphenol-(meth)acrylic acid ester copolymer; poly(meth)acrylic acid or poly(meth)acrylic acid derivatives such as poly(meth) acrylic acid, poly(meth)acrylamide, polyacrylonitrile, polyethyl(meth)acrylate, polybutyl(meth)acrylate and polyisobutyl(meth)acrylate; polyalkylvinyl ethers such as polymethylvinyl ether, polyethylvinyl ether, polybutylvinyl ether and polyisobutylvinyl ether; cellulose or cellulose derivatives such as cellulose, cellulose acetate, cellulose nitrate, hydroxymethylcellulose, hydroxypropylcellulose and carboxymethylcellulose; polyvinyl alcohol; polyvinyl acetals such as polyvinyl alcohol, polyvinyl butyral and polyvinyl formal; nitrogen containing polymers such as polyvinyl pyridine, polyvinyl pyrrolidone, polyethyleneimine and poly-2-methyl-2-oxazoline; polyhalogenated vinyl or polyhalogenated vinyl derivatives such as polyvinyl chloride and polyvinylidene chloride; or their copolymers or mixtures.

The compounds most preferably used among these compounds are those having a high glass transition temperature such as polyhydroxystyrene, polystyrene sulfonic acid, vinylphenol-(meth)acrylic acid ester copolymer and styrene-vinylphenol-(meth)acrylic acid ester copolymer. It is preferable that the copolymer composition soluble in the polymerization solvent preferably has a weight average molecular weight of 3,000 to 300,000, more preferably 5,000 to 150,000, so as to maintain the agglomeration resistance by the presence of the methanol-soluble resin component as well as to provide good low temperature fixability.

Examples of the preferable polymerization solvent to be used in the present invention are mixed solvents containing, based on the weight of the mixed polymerization solvent, 30 to 99.9% by weight of methanol, ethanol or a mixture thereof, and water. Other organic solvents can be also used in the range below 20% by weight. Preferably, the organic solvents to be used together are those that do not react with the polymerizable monomer composition. The content of water is 0.1 to 50.0% by weight, preferably 0.1 to 40.0% by weight, more preferably 0.1 to 30.0% by weight and most preferably 0.5 to 20.0% by weight. When a large amount of water exceeding 50.0% by weight is present, there is a problem in that uniform toner particles can not be obtained.

Examples of the solvents that can be used together are alcohols such as 1-propanol, 2-propanol, 1-butanol, 2-butanol, isobutyl alcohol, tert-butyl alcohol, 1-pentanol, 2-pentanol, 3-pentanol, 2-methyl-1-butanol, isopentyl alcohol, tert-pentyl alcohol, 1-hexanol, 2-methyl-1-pentanol, 4-methyl-2-pentanol, 2-ethylbutanol, 1-heptanol, 2-heptanol, 3-heptanol, 2-octanol, 2-ethyl-1-hexanol, benzyl alcohol and cyclohexanol; ether-alcohols such as methyl cellosolve, cellosolve, isopropyl cellosolve, butyl cellosolve, diethylene glycol and monobutyl ether; ketones such as acetone, methylethyl ketone, methylisobutyl ketone and cyclohexanone; esters such as ethyl acetate, butyl acetate, ethyl propionate and cellosolve acetate; aliphatic or aromatic hydrocarbons such as pentane, 2-methylbutane, n-hexane, cyclohexane, 2-methylpentane, 2,2-dimethylbutane, 2,3-dimethylbutane, heptane, n-octane, isooctane, 2,2,3-trimethylpentane, decane, nonane, cyclopentane, methyl cyclopentane, methyl cyclohexane, ethyl cyclohexane, p-menthane, bicyclohexyl, benzene, toluene, xylene and ethyl benzene; halogenated hydrocarbons such as carbon tetrachloride, trichloroethylene, chlorobenzene and tetrabromoethane; ethers such as ethylether, dimethylether and trioxane tetrahydrofuran; acetals such as methyral and diethylacetal; fatty acids such as formic acid, acetic acid and propionic acid; and sulfur-or nitrogen-containing organic compounds such as nitropropene, nitrobenzene, dimethylamine, monoethanolamine, pyridine, dimethylformamide and dimethylsulfoxide.

Examples of the polymerizable monomers to be used in the present invention are styrene or styrene derivatives such as styrene, o-methylstyrene, m-methylstyrene, p-methoxystyrene, p-ethylstyrene and p-tert-butylstyrene; acrylic acid or acrylic acid esters such as acrylic acid, methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, 2-hydroxyethyl acrylate, phenyl acrylate and dimethylaminoethyl acrylate; methacrylic acid or methacrylic acid esters such as methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, 2-hydroxyethyl methacrylate, phenyl methacrylate, dimethylaminomethyl methacrylate, dimethylaminoethyl methacrylate, diethylaminoethyl methacrylate, benzyl methacrylate, phosphoxyethyl methacrylate and phosphoxypropyl methacrylate; acrylonitrile; methacrylonitrile; acrylamide; acryloylmorphorine; crotonic acid; isocrotonic acid; vinyl ethers such as methylvinyl ether, ethylvinyl ether, propylvinyl ether, n-butylvinyl ether, isobutylvinyl ether, -chloroethylvinyl ether, phenylvinyl ether, p-methylphenylvinyl ether, p-chlorophenylvinyl ether, p-bromophenylvinyl ether, p-nitrophenylvinyl ether and p-methoxyphenylvinyl ether; diene compounds such as butadiene; dibasic acid monomers such as itaconic acid, maleic acid, fumaric acid, monobutyl itaconate and monobutyl maleate; and heterocyclic monomers such as 2-vinylpyridine, 3-vinylpyridine, 4-vinylpyridine, N-vinylpyrroridone, 2-vinylimidazole, N-methyl-2-vinylimidazole and N-vinylimidazole.

These monomers can be used alone or in combination of two or more kinds of such compounds which are selected to obtain a suitable polymer composition having advantageous characteristics.

According to the present invention, high molecular weight components or gel components can be incorporated. Introduction of these components can be accomplished by using cross-linking agents having two or more polymerizable double bonds in one molecule.

Examples of the cross-linking agents are aromatic divinyl compounds such as divinylbenzene and divinylnaphthalene, ethyleneglycol diacrylate, ethyleneglycol dimethylacrylate, triethyleneglycol dimethylacrylate, tetraethyleneglycol dimethylacrylate, 1,3-butyleneglycol dimethacrylate, trimethylolpropane triacrylate, trimethylolpropane trimethacrylate, 1,4-butanediol diacrylate, neopentylglycol diacrylate, 1,6-hexanediol diacrylate, pentaerythritol triacrylate, pentaerythritol tetracrylate, pentaerythritol dimethacrylate, pentaerythritol dimethacrylate, pentaerythritol tetramethacrylate, glycerolacryloxy dimethacrylate, N,N-divinylaniline, divinyl ether, divinylsulfide and divinylsulfone. They may be used by appropriately mixing two or more kind of such compounds. These cross-linking agents may be pre-mixed with the polymerizable mixture or may be appropriately added during the polymerization reaction when required.

The washing step after the polymerization reaction is important for the purpose of allowing the methanol-soluble resin component of the toner to be present in a prescribed amount in the production process according to this invention. While a solvent identical to the polymerization solvent may be used, it is preferable to use a mixed washing solvent containing at least water and 30% by weight of saturated alcohols represented by the following formula (1):

$$C_nH_{2n+1}OH \quad (1)$$

wherein n is an integer of 1 to 5.

It is preferable to employ 0.1 to 70% by weight of water in the washing solvent to be used in the washing step. The washing solvent is preferably a solvent in which the products are less soluble as compared to the polymerization solvent. A second washing step where the resin is washed with water, after washing with the washing solvent, is preferably employed as part of the washing step.

It is important that the steps described above are carried out for the purpose of allowing a prescribed amount of the polymer composition to exist on the toner surface as well as to eliminate very low molecular weight components. Repeating the washing steps 1 to 10 times makes it possible for a prescribed amount of surface composition to be present even when different materials are used.

After washing, the toner after is dried. The drying step is not particularly limited and any conventional drying method can be used to obtain the toner.

The toner according to the present invention may be subjected to classification after drying.

All types of colorants known to the art can be used in the present invention. Any coloring method including a method for allowing the colorant to be included in the polymerizable monomer composition together with the polymerizable monomer to incorporate the colorant into the polymerized particles instantaneously with polymerization, or a method for dying the polymerized particles with a dye in a warm solvent can be used. However, the coloring method in which the surface of the toner particles is modified by mechanically bombarding the surface with the colorant after the polymerized particles have been produced is not preferred.

Examples of the organic colorants are dyes such as C. I. Direct Red 1, C. I. Basic red 1, C. I. Mordant Red 30, C. I. Direct Blue 1, C. I. Direct Blue 2, C. I. Acid Blue 15, C. I. Basic Blue 3, C. I. Basic Blue 5, C. I. Mordant Blue 7, C. I. Direct Green 6, C. I. Basic green 4, C. I. Basic Green 6; pigments such as Cadmium Yellow, Mineral Fast Yellow, Naval Yellow, Naphthol Yellow S, Hansa yellow G, Permanent Yellow NCG, tartrazine lake, Molybdenum Orange GTR, Benzidine Orange G, Cadmium Red 4R, Watchung Red calcium salt, Brilliant Carmine 3B, Fast Violet B, Methyl Violet Lake, Cobalt Blue, Alkali blue Lake, Victoria Blue Lake, quinacridone, Rhodamine Lake, Phthalocyanine Blue, Fast Sky Blue, Pigment Green B, Malachite Green B, Malachite Green Lake, Final Yellow Green G; dyes such as C. I. Solvent Yellow 6, C. I. Solvent yellow 9, C. I. Solvent Yellow 17, C. I. Solvent Yellow 31, C. I. Solvent Yellow 35, C. I. Solvent Yellow 100, C. I. Solvent Yellow 102, C. I. Solvent Yellow 103, C. I. Solvent Yellow 105, C. I. Solvent Orange 2, C. I. Solvent Orange 7, C. I. Solvent Orange 13, C. I. Solvent Orange 14, C. I. Solvent Orange 66, C. I. Solvent Red 5, C. I. Solvent Red 16, C. I. Solvent Red 17, C. I. Solvent Red 18, C. I. Solvent red 19, C. I. Solvent red 22, C. I. Solvent Red 23, C. I. Solvent red 143, C. I. Solvent Red 145, C. I. Solvent Red 146, C. I. Solvent Red 149, C. I. Solvent Red 150, C. I. Solvent Red 151, C. I. Solvent Red 157, C. I. Solvent Red 158, C. I. Solvent Violet 31, C. I. Solvent Violet 32, C. I. Solvent Violet 33, C. I. Solvent Violet 37, C. I. Solvent Blue 22, C. I. Solvent Blue 63, C. I. Solvent Blue 78, C. I. Solvent Blue 83, C. I, Solvent Blue 84, C. I, Solvent Blue 85, C. I, Solvent Blue 86, C. I, Solvent Blue 104, C. I, Solvent Blue 191, C. I, Solvent Blue 194, I, Solvent Blue 195, C. I. Solvent Green 24, Solvent Green 25, C. I. Solvent Brown 3 and C. I. Solvent Brown 9.

Examples of the commercially available dyes are Diaresin Yellow-3G, Yellow-F, Yellow-H2G, Yellow-HG, Yellow-HC, Yellow-HL, Orange-HS, Orange-G, Red-GG, Red-S, Red-HS, Red-A, Red-K, Red-H5B, Violet-D, Blue-J, Blue-G, Blue-N, Blue-K, Blue-P, Blue-H3G, Blue-4G, Green-C and Brown-A made by Mitsubishi Kasei Co.; Indigo Dying SOT dye, Yellow-1, Yellow-3, Yellow-4, Orange-1, Orange- 2, Orange-3, Scarlet-1, Red-1, Red-2, Red-3, Brown-2, Blue-1, Blue-2, Violet-1, Green-1, Green-2, Green-3, Black-1, Black-4, Black-6 and Black-8 made by Hodogaya Chemical Co.; Oilblack, Oilcolor Yellow-3G, Yellow-GG-S, Yellow-#105, Orange-PS, Orange-PR, Orange-#201, Scarlet-#308, Red-5B, Brown-GR, Brown-#416, Green-BG, Green-#502, Blue-BOS, Blue-IIN, Black-HBB, Black-#803, Black-EB and Black-EX made by Orient Chemical Industry Co.; Sumiplast Blue GP, Blue OR, Red FB, Red 3B, Yellow FL7G and Yellow GC made by Sumitomo Chemical Industry Co.; and Kayaron Polyester Black EX-SF300, Kayaset Red B and Blue A-2R made by Nihon Kayaku Co.

Magnetic toners as colorants using magnetic materials can be also obtained in the present invention.

Any of the initiators known in the art can be used in the present invention. Examples of these initiators which are radical polymerization initiators include azo- or diazo-polymerization initiators such as 2,2'-azobis-(2,4-dimethylvaleronitrile), 2,2'-azobisisobutyronitrile, 1,1'-azobis-(cyclohexane-1-carbonitrile) and 2,2'-azobis-4-methoxy-2,4-dimethylvaleronitrile; amidine compounds such as 2-2'-azobis-(2-aminodipropane) dihydrochloride, 2,2'-azobis (N,N'-dimethyleneisobutylamidine) and 2,2'-azobis-(N,N'-dimthyleneisobutylamidine) dihydrochloride; peroxide polymerization initiators such as benzoylperoxide, methylethyl ketone peroxide, diisopropyl peroxycarbonate, cumene hydroperoxide, 2,4-dichlorobenzoyl peroxide and lauroyl peroxide; and persulfate polymerization initiators such as potassium persulfate and ammonium persulfate, and mixtures of the initiators listed above.

Examples of anion polymerization initiators are strong alkalis such as $SrR_2$, $CaR_2$, K, KR, Na, NaR, Li, LiR, ketyl, R—MgR, R—ONa, R—OLi, sodium hydroxide and potassium hydroxide; weak alkalis such as pyridine and ammonia; and R—O—R in water (where R denotes an alkyl group).

$SnCl_4$, $BF_3$, $AlCl_3$ and $TiCl_3$, for example, can be used as cation polymerization initiators.

Chain transfer agents known in the art, for example halogenated hydrocarbons such as carbon tetrachloride, carbon tetrabromide, ethyl dibromoacetate, ethyl tribromoacetate, dibromoethylbenzene, dibromoethane and dichloroethane; hydrocarbons such as diazothioether, benzene, ethylbenzene and isopropylbenzene; mercaptans such as tert-dodecylmercaptan and n-dodecylmercaptan; and disulfides such as diisopropylxantogene disulfide can be added in the present invention.

Charge control agents for controlling electrostatic charge can be added in the toner according to the present invention. Any of the conventional charge control agents or negative charge control agents known in the art can be used as charge control agents. Examples of the charge control agents are nigrosine dyes, triphenylmethane dyes, tertiary ammonium salts, amine or imine compounds, metal compounds of salicylic acid or alkylsalicylic acid, metal-containing monoazo dyes, compounds having carboxyl or sulfoxyl groups, fumic acids such as nitrofumine and fumine salts.

Various kind of external additives can be added to the toner according to this invention for improving fluidity and charging ability. Any of the external additives known in the art used for toners can be used as an external additive. Examples of external additives are fine powders of such as silica, titanium oxide and alumina. External additives preferably used in the present invention are those having a BET value of 300 $m^2/g$ or more. While an external additive with a BET value of less than 300 $m^2/g$ is possible, those having a BET value of 300 $m^2/g$ or more are more preferred for making the particle size fine, maintaining a uniform surface of the toner having a sharp particle size distribution and allowing a good electrostatic charging.

The toner according to the present invention can be used as a two-component developer by mixing with carrier particles. Conventional carriers such as iron powder, magnetite, ferrite and magnetic material dispersed resin carriers can be used. It is preferable that the carrier has a number average particle size of 30 m or less for endowing the toner with sufficient degree of electrostatic charge.

The methods for measurement to be used in the present invention will be described hereinafter.

(1) Extraction of soluble resin component of the toner by Soxhlet extraction:

The Soxhlet extractor shown in FIG. 1 is used for the extraction of the soluble resin component.

Ten grams of the toner powder are precisely weighed ($W_1$) and placed in a cylindrical filter paper 2 having an inner diameter B of 24 mm as a sample 4. This cylindrical filter paper 2 is set into an extractor 8 having an inner diameter A of 33 mm.

Then, 150 g of reagent grade methanol is placed into a flask 7 and the flask is dipped in a warm water bath 5. Onto a extraction tube 11 a cooling tube 1 is set, through which cooling water flows through. When the temperature of the warm water bath is raised to 80° C., refluxing of methanol starts to add methanol dropwise onto the sample. A boiling bubble stone 10 may be employed to assist in refluxing. The extracting solvent after the extraction is collected in the flask. After extracting for 20 hours, the extraction solution is placed in a beaker. Methanol is evaporated off under a vacuum and the residue, a methanol soluble fraction, is precisely weighed ($W_2$). The used flask is replaced with a fresh one and 150 g of THF is placed in the flask. Extraction is carried out for 10 hours by the same procedure as extraction with methanol. The extraction solution is placed in a beaker and, after evaporating the THF off, the residue is weighed ($W_3$) as a THF-soluble resin component.

Methanol-soluble resin component (% by weight)=$w_2/w_1 \times 100$

Figure 2:
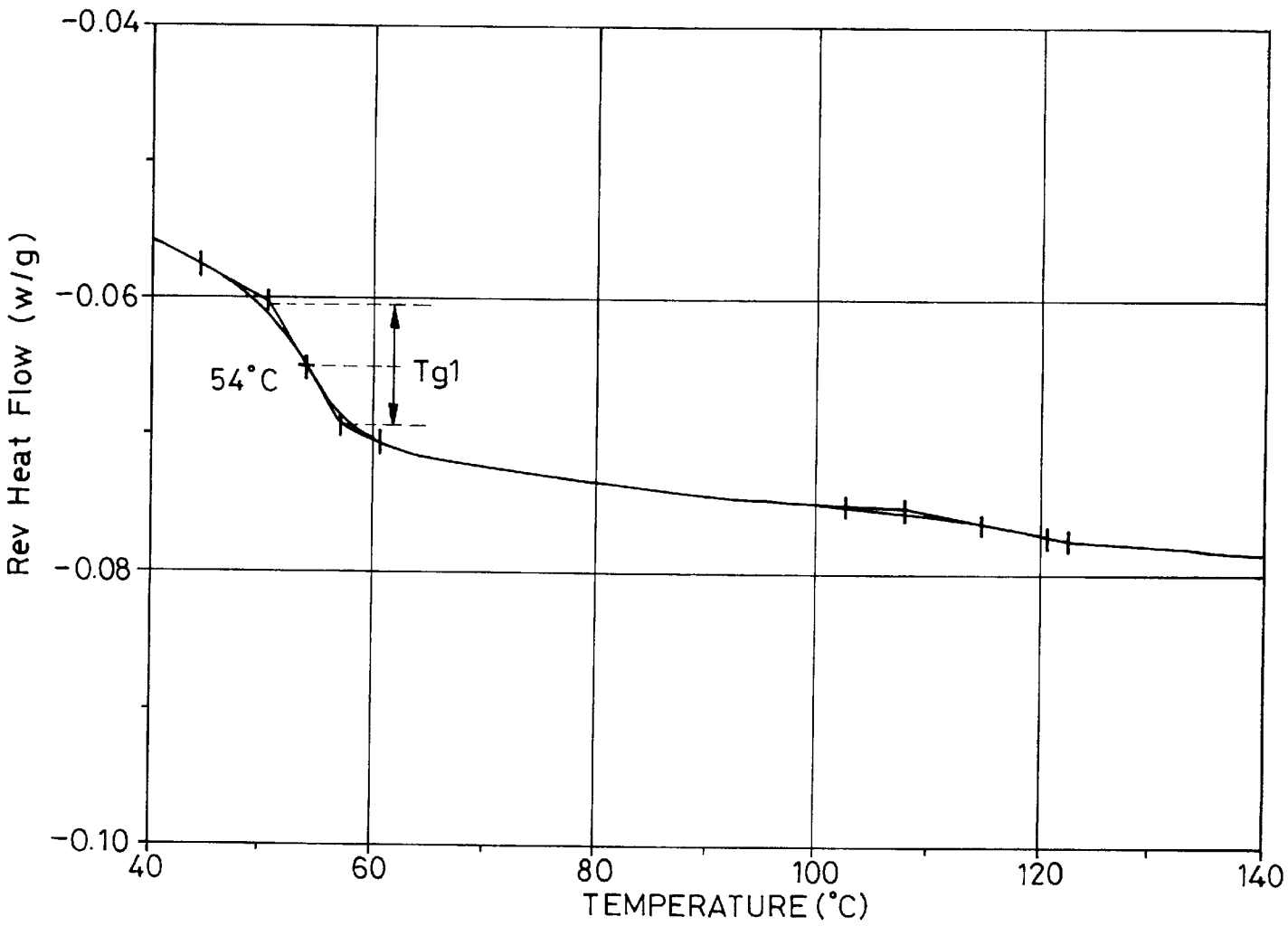
FIG. 2 shows a DSC curve of the THF soluble resin component of the toner in Example 1 for explaining the maximum glass transition point ($Tg_1$) of the THF soluble resin component.
Figure 3:
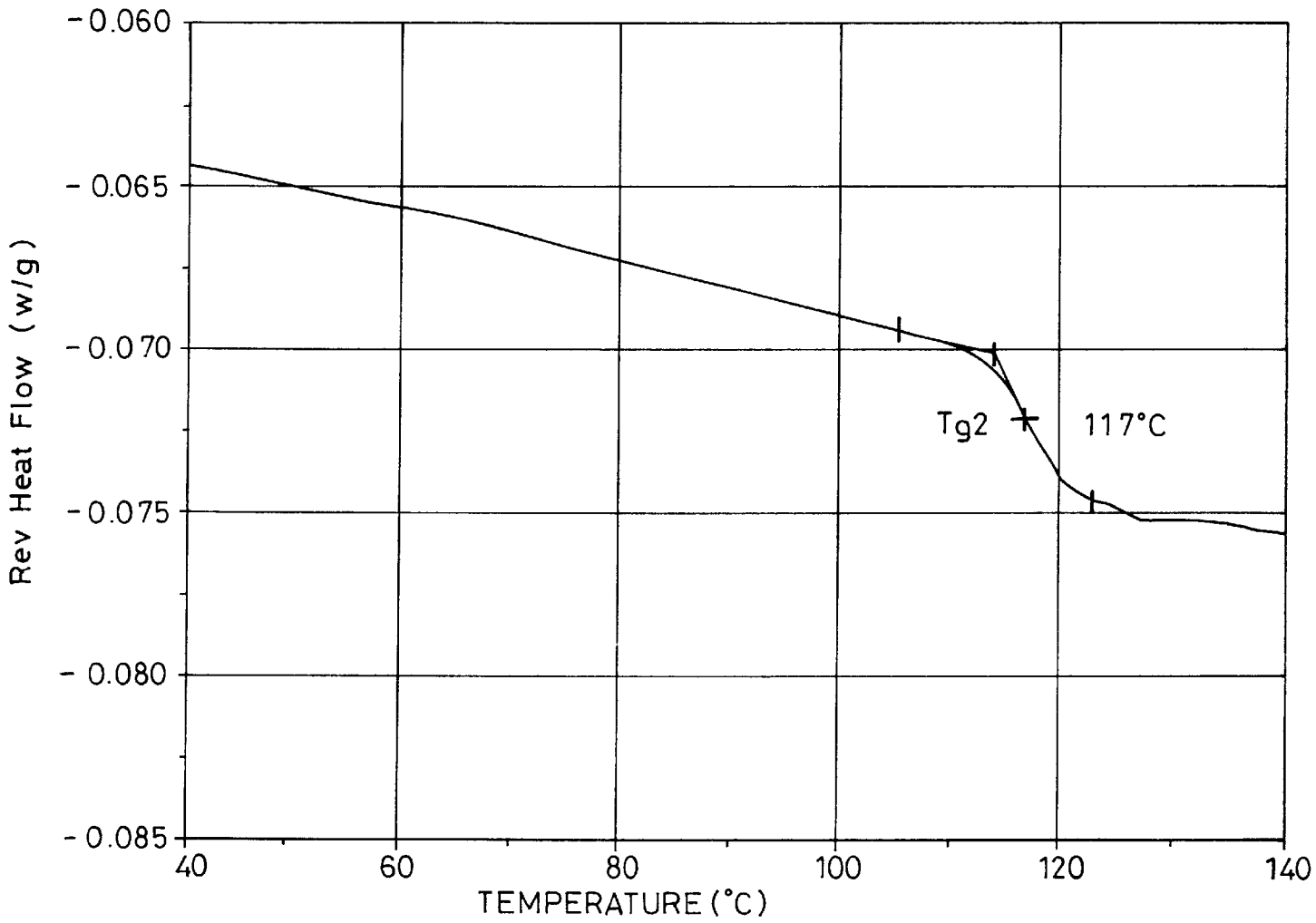
FIG. 3 is a DSC curve of the methanol soluble resin component in Example 1 for explaining the maximum glass transition point ($Tg_2$) of the methanol-soluble resin component.

THF-soluble resin component (% by weight)=$W_3/W_1 \times 100$ (2) The maximum glass transition point ($Tg_1$) of the THF-soluble resin component and highest glass transition point ($Tg_2$) of methanol-soluble resin component are measured with a DSC measuring apparatus (M-DSC, made by TA-Instruments Co.) under the environment of a normal temperature and a normal humidity. At first, 6 mg of the sample is precisely weighed. The sample is placed in an aluminum pan and, using an empty pan as a reference, a DSC curve is recorded at a temperature range of 20° C. to 200° C. with a temperature increase rate of 4° C./min. The measuring conditions are modulation amplitude of ±0.6° C. and a frequency of 1/min. As shown in FIGS. 2 and 3, the maximum glass transition temperature (Tg) is calculated from the reversing heat flow curve. Tg is calculated from a center point of each cross point (2 points) between the base line and tangent lines of the endothermic curve. When a plurality of endothermic curves is observed, a Tg obtained from the maximum (most wide) endothermic part (FIG. 2) is defined as the maximum glass transition point ($Tg_1$) of the THF-soluble resin component, while a Tg showing the highest temperature (FIG. 3) is defined as the highest glass transition point ($Tg_2$) of the methanol-soluble resin component.

(3) The molecular weight distribution of the toner is measured using a GPC measuring apparatus (HLC-8129GPC, made by Toso Co.).

Measuring conditions:

Column: TSK gel HM-M (6.0 mm×15 cm), two columns in series

Temperature: 40° C.

Solvent: THF

Flow rate: 0.6 ml/min.

Detector: RI

Sample concentration: 10 μg of sample in 0.1% solution

The sample is placed in THF and sufficiently shaken (until coagulated sample has disappeared) after allowing the sample to stand in THF for several hours. The sample solution is allowed to stand for additional 12 hours. A GPC sample is prepared by passing the sample solution through a sampling filter (pore size 0.45 μm).

A weight average molecular weight constitution curve obtained by using a single dispersion polystyrene standard sample is used for calibration. The maximum molecular weight is determined from the logarithmic curve (log M) obtained. From an integral curve corresponding to a molecular weight region of 200 to 1000, the amount of the very low molecular weight component contained in the toner resin is calculated.

(4) For the toner having a number average particle size of 1 μm or more, particle size of the toner used in the present invention is measured using a laser scanning type particle size distribution measuring apparatus (CIS-100, made by GALAI Co.) for particles within a particle size range of 0.4 to 60 μm. 0.5 to 2 mg of toner is added to a solution prepared by adding to water 0.2 ml of a detergent (alkylbenzene sulfonic acid salt) and the particles are dispersed with an ultrasonic dispersion device for 2 minutes. Then, about 80% volume of water relative to the volume of a cubic cell is placed in the cubic cell equipped with a stirrer and one to two drops of the sample solution previously subjected to ultrasonic dispersion is added to the cell. The number average particle size, particle size distribution coefficient and variation coefficient are determined based on the volume average particle size (Dv), number average particle size (Dn) and standard deviation (S.D.) obtained from the measurement.

For the toner having a number average particle size of 1 μm or less, a photograph magnified by 5000 times is taken using a scanning type electron microscope (FE-SEMS-800, made by Hitachi Seisakusho Co.). Horizontal Ferrel diameter is measured from the photograph for particles having a particle size of 0.05 μm or more so that the accumulated particle number reaches 300 or more. The average number of the above measurement is defined as a number average particle size. The volume average particle size and variation coefficient are determined based on the measure values by the same calculation formula as used in CIS-100.

(5) The method for measuring the frictional charge will be described hereinafter. The toner and carrier are mixed in an appropriate mixing ratio (2 to 15% by weight) for use as a developer and are mixed with a tubular mixer for 180 seconds. This mixed powder is placed in a vessel made of a metal equipped with a 635 mesh conductive screen at the bottom. After aspirating the powder with an aspirator, the frictional charge is determined from the weight difference of the vessel before and after the aspiration and from the electric potential accumulated on the condenser connected to the vessel. The suction pressure in this measurement is adjusted to 250 mmHg. The frictional charge is calculated from the following equation.

$$Q(\mu C/g)=(C\times V)/(W_1-W_2)$$

(in the equation, $W_1$ is the weight before suction and $W_2$ is the weight after suction, C is the capacity of the condenser, and V is the electric potential accumulated on the condenser)

The present invention provides a fine particle toner having a sharp molecular weight distribution. By allowing a surface resin fraction soluble in methanol to be present on the toner surface, high quality images can be obtained without agglomerating the toner even at high temperatures and the toner exhibits good low temperature fixability.

Though the present invention is described by way of preferred examples, it is not to be limited in any sense by such examples. The term "parts" used in the example always means "parts by weight".

EXAMPLE 1

| | |
|---|---|
| Methanol | 540 parts |
| Water | 60 parts |
| Polyvinylphenol (weight average molecular weight 45,000) | 60 parts |
| Styrene | 100 parts |
| n-Butyl acrylate | 35 parts |
| Carbon black | 5 parts |
| Metal compound of di-t-butyl salicylic acid | 1 part |
| 2,2'-azobisisobutyronitrile | 9.6 parts |

The mixture above was placed in a 5-liter reaction vessel equipped with a reflux condenser, thermometer, nitrogen introducing tube and mechanical stirrer and the solution was thoroughly stirred while bubbling nitrogen therethrough. The temperature of an oil bath in which the reaction vessel is immersed was adjusted to 80° C. and the solvent was refluxed under a nitrogen atmosphere for 12 hours.

After cooling the reaction mixture to room temperature, solid-liquid separation and washing were repeated. A mixed solvent prepared by mixing 80% by weight of methanol and 20% by weight of water was used for washing. This procedure was repeated 7 times and the product was finally washed with water. The slurry obtained was dried to obtain the toner particles having a number average particle size (Dn) of 4.02 μm, the ratio (Dv/Dn) between the volume average particle size (Dv) and number average particle size (Dn) of 1.03 and variation coefficient of particle size distribution of 13.7%.

After the first Soxhlet exaction with methanol, the proportion of the methanol-soluble resin component was 0.4% by weight. From the result of the succeeding second Soxhlet extraction with THF, the proportion of the THF-soluble resin component was 95.6% by weight. As shown in FIGS. 2 and 3, from the measurements of the glass transition points of the THF-soluble resin component and methanol-soluble resin component, it was found that the maximum glass transition point $Tg_1$ of the THF-soluble resin component was 54° C. while the maximum glass transition point $Tg_2$ of the methanol-soluble resin component was 117° C.

The maximum peak in the molecular weight distribution of the THF-soluble resin component after the extraction with methanol showed a molecular weight of 20,100, containing 0.5% by weight of polymer component with a molecular weight of 200 to 1,000.

An external additive was combined with the toner particles by mixing 3 parts of titanium oxide subjected to crushing and having a BET value of 350 $m^2/g$ to 100 parts of the toner obtained using a Henshel mixer.

Then, 93% by weight of carrier with a mean particle size of 35 μm formed by coating a ferrite core with a silicone resin was placed in a plastic bottle together with 7% by weight of the toner containing the external additive, and a two-component developer was prepared by mixing and stirring with a tubular mixer.

This two-component developer was placed into a reassembled full-color laser copy machine CLC 500 (made by Canon Inc.) to evaluate image quality. The surface roughness of the developer retaining surface of the development device was matted to Rz=10. The laser spot diameter was narrowed to 20% of the usual diameter to precisely evaluate the reproducibility of half-tone images with very fine dot.

The method for evaluating the reproducibility of half-tone images with very fine dots is as follows: using a multivalue recording method by a pulse width modulation of a laser beam in one pixel, reproducibility of the very fine spots was evaluated by a microscopic observation of toner images of the very fine spots on a transfer medium after transferring the spots on the medium. In addition, the image quality was evaluated after allowing the copy machine to be left in a high temperature and high humidity condition (30° C., 80% RH) for 7 days. The result indicated that reproducibility of the half-tone images as well as that of the half-tone images after standing for 7 days was satisfactory.

The appearance of the two-component developer after standing for 7 days was as a fluid powder and no agglomeration was observed.

Next, a fixing test was carried out using an auxiliary fixing device having the same construction as that of the CLC-500 copier. After forming a strip of non-fixed images having a dimension of 2 cm in width and 10 cm in length on a recording medium, the non-fixed images were allowed to pass through a roller along the longitudinal direction of the strip while monitoring the temperature of the upper roller of the auxiliary fixing device. The temperature when no offset was observed at the end of the strip was defined as the fixing initiation temperature. The result showed that the initiation temperature was 140° C. since no offset was observed at 140° C.

The temperature of the upper roller was adjusted by increasing the temperature stepwise by 5° C. starting from 100° C. After confirming that the temperature of the upper roller had reached the desired temperature, the recording medium having unfixed images was passed through the fixing device. In the temperature range between the temperature (A ° C.) when no offset appeared and the previously adjusted temperature (A ° C.−5° C.) before offset appeared, the temperature of the upper roller was increased stepwise by 1° C. starting from the previously adjusted temperature (A ° C.−5° C.). A fixing test was carried out the in the temperature range above and the temperature when no offset appeared was determined to be a fixing start temperature.

EXAMPLE 2

Polymerization was carried out by the same method as described in Example 1. After cooling the polymerization solution to room temperature, solid-liquid separation and washing of the dispersion solution was repeated. A mixed solvent prepared by mixing 50% by weight of methanol and 50% by weight of water was used for washing. This procedure was repeated 5 times and the product was finally washed with water. The slurry obtained was dried to obtain toner particles having a number average particle size (Dn) of 4.13 μm, a ratio (Dv/Dn) between the volume average particle size (Dv) and number average particle size (Dn) of 1.05 and a variation coefficient of particle size distribution of 15.8%.

After the first Soxhlet exaction with methanol, the proportion of the methanol-soluble resin component was 1.7% by weight. After the succeeding second Soxhlet extraction with THF, the proportion of the THF-soluble resin component was 95.2% by weight. From the measurements of the glass transition points of the THF-soluble resin component and methanol-soluble resin component, it was found that the maximum glass transition point $Tg_1$ of the THF-soluble resin component was 53° C. while the maximum glass transition point $Tg_2$ of the methanol-soluble resin component was 117° C.

The maximum peak in the molecular weight distribution of the THF-soluble resin component after the extraction with methanol showed a molecular weight of 19,500, and the resin contained 0.6% by weight of polymer component with a molecular weight of 200 to 1,000.

A toner with an external additive was prepared by adding titanium oxide to the toner obtained as described in Example 1.

Image quality was evaluated after preparing a two-component developer by mixing this toner with the carrier by the same method as used in Example 1. The result indicated that the reproducibility of the half-tone images as well as that after standing were satisfactory. The appearance of the developer after the evaluation of image quality was as a fluid powder without any agglomeration.

From the results of a fixing test using an auxiliary fixing device having the same construction as the CLC-500 copier, it was found that the fixing initiation temperature was 144° C.

EXAMPLE 3

Polymerization was carried out by the same method as described in Example 1. After cooling the polymerization solution to room temperature, solid-liquid separation and washing of the dispersion solution was repeated. A mixed solvent prepared by mixing 40% by weight of methanol and 60% by weight of water was used for washing. This procedure was repeated twice and the product was finally washed with water. The slurry obtained was dried to obtain the toner particles having a number average particle size (Dn) of 4.06 μm, a ratio (Dv/Dn) between the volume average particle size (Dv) and number average particle size (Dn) of 1.07 and a variation coefficient of particle size distribution of 17.8%.

After the first Soxhlet exaction with methanol, the proportion of the methanol-soluble resin component was 3.6% by weight. From the result of the succeeding second Soxhlet extraction with THF, the proportion of the THF-soluble resin component was 92.9% by weight. From the measurements of the glass transition points of the THF-soluble resin component and methanol-soluble resin component, it was found that the maximum glass transition point $Tg_1$ of the THF-soluble resin component was 54° C. while the maximum glass transition point $Tg_2$ of the methanol-soluble resin component was 120° C.

The maximum peak in the molecular weight distribution of the THF soluble resin component after the extraction with methanol showed a molecular weight of 20,300, and the resin component contained 0.9% by weight of polymer component with a molecular weight of 200 to 1,000.

A toner having an external additive was prepared by adding titanium oxide to the toner obtained as described in Example 1.

Image quality was evaluated after preparing a two-component developer by mixing this toner with the carrier by the same method as used in Example 1. The results indicated that the reproducibility of the half-tone images as well as that after standing were satisfactory.

From the results of a fixing test using an auxiliary fixing device having the same construction as the CLC-500 copier, it was found that the fixing initiation temperature was 150° C.

COMPARATIVE EXAMPLE 1

| | |
|---|---|
| Methanol | 600 parts |
| Polyvinylphenol (weight average molecular weight 45,000) | 60 parts |
| Styrene | 100 parts |
| n-Butyl acrylate | 35 parts |
| Carbon black | 5 parts |
| Metal compound of di-t-butyl salicylic acid | 1 part |
| 2,2'-azobisisobutyronitrile | 9.6 parts |

The mixture above was placed in a 5-liter reaction vessel equipped with a reflux condenser, thermometer, nitrogen-introducing tube and mechanical stirrer and the solution was thoroughly stirred while bubbling nitrogen therethrough. The temperature of an oil bath in which the reaction vessel was immersed was adjusted to 70° C. and the solvent was refluxed under a nitrogen atmosphere for 12 hours.

After cooling the reaction mixture to room temperature, solid-liquid separation and washing were repeated. Ethanol was used as an washing solvent. This procedure was repeated 7 times. The slurry obtained was dried to obtain toner particles having a number average particle size (Dn) of 4.23 $\mu$m, a ratio (Dv/Dn) between the volume average particle size (Dv) and number average particle size (Dn) of 1.07 and a variation coefficient of particle size distribution of 17.8%.

After the first Soxhlet exaction with methanol, the proportion of the methanol-soluble resin component was 0.01% by weight. From the result of the succeeding second Soxhlet extraction with THF, the proportion of the THF-soluble resin component was 98.0% by weight. From the measurements of the glass transition points of the THF-soluble resin component and methanol-soluble resin component, it was found that the maximum glass transition point $Tg_1$ of the THF-soluble resin component was 57° C. while the maximum glass transition point $Tg_2$ of the methanol-soluble resin component was 57° C.

The maximum peak in the molecular weight distribution of the THF-soluble resin component after the extraction with methanol showed a molecular weight of 22,000 and the resin component contained 0.05% by weight of polymer component with a molecular weight of 200 to 1,000.

A toner having an external additive was prepared by adding a fine powder of titanium by the same method as described in Example 1.

A carrier was mixed with this toner as described in Example 1 to prepare a two-component developer for evaluation of image quality. The results indicated that, although reproducibility of half-tone images was good, scattering was observed in dot reproducibility after standing. Fogging of the toner was observed at non-image portions. Packing of the developer was also observed in the developer vessel after the evaluation.

A fixing test was carried out using an auxiliary fixing device having the same construction as that of the CLC-500 copier. From the results, the fixing initiation temperature was 142° C.

COMPARATIVE EXAMPLE 2

Polymerization was carried out by the same method as described in Example 1. After cooling the reaction mixture to room temperature, solid-liquid separation and washing were repeated. A washing solvent was prepared by mixing 40% by weight of methanol and 60% by weight of water. This procedure was repeated once and the product was finally washed with water. The slurry obtained was dried to obtain toner particles having a number average particle size (Dn) of 4.11 $\mu$m, a ratio (Dv/Dn) between the volume average particle size (Dv) and number average particle size (Dn) of 1.09 and a variation coefficient of particle size distribution of 23.0%.

After the first Soxhlet exaction with methanol, the proportion of the methanol-soluble resin component was 7.6% by weight. From the result of the succeeding second Soxhlet extraction with THF, the proportion of the THF-soluble resin component was 89.7% by weight. From the measurements of the glass transition points of the THF-soluble resin component and methanol-soluble resin component, it was found that the maximum glass transition point $Tg_1$ of the THF-soluble resin component was 57° C. while the maximum glass transition point $Tg_2$ of the methanol-soluble resin component was 90° C.

The maximum peak in the molecular weight distribution of the THF-soluble resin component after the extraction with methanol showed a molecular weight of 21,500 and the resin component contained 0.9% by weight of polymer component with a molecular weight of 200 to 1,000.

A toner with an external additive was prepared by adding a fine powder of titanium by the same method as described in Example 1.

A carrier was added to this toner as described in Example 1 to prepare a two-component developer for evaluation of image quality. The results indicated that reproducibility of half-tone images was good and reproducibility after standing was also excellent. Packing of the developer was not observed after the evaluation.

A fixing test was carried out using an auxiliary fixing device having the same construction as that of the CLC-500 copier. From the results, the fixing initiation temperature was 163° C., indicating that the fixing initiation temperature was high.

COMPARATIVE EXAMPLE 3

| | |
|---|---|
| Methanol | 600 parts |
| Polymethylvinyl ether (weight average molecular weight 15,000) | 100 parts |
| Styrene | 100 parts |
| n-Butyl acrylate | 35 parts |
| Carbon black | 5 parts |
| Metal compound of di-t-butyl salicylic acid | 1 part |
| 2,2'-azobisisobutyronitrile | 9.6 parts |

The mixture above was placed in a 5-liter reaction vessel equipped with a reflux condenser, thermometer, nitrogen-introducing tube and mechanical stirrer and the solution was thoroughly stirred while bubbling nitrogen therethrough. The temperature of an oil bath in which the reaction vessel is immersed was adjusted to 70° C. and the solvent was refluxed under a nitrogen atmosphere for 12 hours.

After cooling the reaction mixture to room temperature, solid-liquid separation and washing were repeated. A mixed solvent prepared by mixing 40% by weight of methanol and 60% by weight of water was used as a washing solvent. This procedure was applied only once. The slurry obtained was dried to obtain the toner particles having a number average particle size (Dn) of 3.94 μm, a ratio (Dv/Dn) between the volume average particle size (Dv) and number average particle size (Dn) of 1.09 and a variation coefficient of particle size distribution of 22.1%.

After the first Soxhlet exaction with methanol, the proportion of the methanol soluble resin component was 6.3% by weight. From the result of the succeeding second Soxhlet extraction with THF, the proportion of the THF-soluble resin component was 91.7% by weight. From the measurements of the glass transition points of the THF-soluble resin component and methanol-soluble resin component, it was found that the maximum glass transition point $Tg_1$ of the THF-soluble resin component was 55° C. while the maximum glass transition point $Tg_2$ of the methanol-soluble resin component was 51° C.

The maximum peak in the molecular weight distribution of the THF soluble resin component after the extraction with methanol showed a molecular weight of 23,500 and the resin component contained 0.8% by weight of polymer component with a molecular weight of 200 to 1,000.

A toner having an external additive was prepared by adding a fine powder of titanium by the same method as described in Example 1.

A carrier was added to this toner as described in Example 1 to prepare a two-component developer for evaluation of image quality. The results indicated that, although reproducibility of half-tone images was good, fogging of the toner was observed and scattering of the toner was observed in the reproduction test after standing. Fogging of the toner was also observed at non-image portions. Packing of the developer was also observed in the developer vessel after the evaluation.

A fixing test was carried out using an auxiliary fixing device having the same construction as that of the CLC-500 copier. From the results, the fixing initiation temperature was 135° C.

COMPARATIVE EXAMPLE 4

| | |
|---|---|
| Water | 600 parts |
| SDS (sodium dodecylsulfate) | 1 part |
| Polylvinyl alcohol | 5 parts |
| Styrene | 100 parts |
| n-Butyl acrylate | 35 parts |
| carbon black | 5 parts |
| Metal compound of di-t-butyl salicylic acid | 1 part |
| 2,2'-azobisisobutyronitrile | 8 parts |

The mixture above was placed in a reaction vessel and particles were formed by stirring with a TK homomixer at a rotation speed of 12000 rpm for 10 minutes. The slurry was thoroughly mixed by bubbling nitrogen in the reaction vessel. Polymerization was continued for 12 hours under a nitrogen atmosphere by adjusting the temperature of an oil bath in which the reaction vessel was immersed to 70° C.

After cooling the reaction mixture to room temperature, solid-liquid separation and washing were repeated. Water was used as an washing solvent. This procedure was repeated 3 times. The slurry obtained was dried to obtain toner particles having a number average particle size (Dn) of 4.15 μm, a ratio (Dv/Dn) between the volume average particle size (Dv) and number average particle size (Dn) of 1.38 and a variation coefficient of particle size distribution of 36.6%.

After the first Soxhlet exaction with methanol, the proportion of the methanol-soluble resin component was 10.4% by weight. From the result of the succeeding second Soxhlet extraction with THF, the proportion of the THF-soluble resin component was 88.0% by weight. From the measurements of the glass transition points of the THF-soluble resin component and methanol-soluble resin component, it was found that the maximum glass transition point $Tg_1$ of the THF-soluble resin component was 59° C. while the maximum glass transition point $Tg_2$ of the methanol-soluble resin component was 46° C.

The maximum peak in the molecular weight distribution of the THF-soluble resin component after the extraction with methanol showed a molecular weight of 20,600 and the resin component contained 6.51% by weight of polymer component with a molecular weight of 200 to 1,000.

A toner having an external additive was prepared by adding a fine powder of titanium by the same method as described in Example 1.

A carrier was added to this toner as described in Example 1 to prepare a two component developer for evaluation of image quality. A distortion of dots was observed in the half-tone reproducibility test with further deterioration in reproducibility after standing.

A fixing test was carried out using an auxiliary fixing device having the same construction as that of the CLC-500 copier. From the result, the fixing initiation temperature was 135° C.

EXAMPLE 4

| | |
|---|---|
| Ethanol | 570 parts |
| Water | 30 parts |
| Vinlyphenol-butylmethacrylate (75:25) copolymer (weight-average molecular weight 28,000) | 50 parts |
| | 50 parts |
| Styrene | 100 parts |
| 2-Ethylhexyl methacrylate | 35 parts |
| Carbon black | 5 parts |
| Metal compound of di-t-butyl salicylic acid | 1 part |
| 2,2'-azobisisobutyronitrile | 10 parts |

The above mixture was placed in a reaction vessel and the solution was thoroughly mixed by bubbling of nitrogen in the reaction vessel. Polymerization was continued for 12 hours under a nitrogen atmosphere by adjusting the temperature of an oil bath in which the reaction vessel was immersed to 85° C.

After cooling the reaction mixture to room temperature, solid-liquid separation and washing were repeated. A solution prepared by mixing 50% by weight of ethanol, 10% by weight of methanol and 40% by weight of water was used for the washing solution. This procedure was repeated 3 times and the product was finally washed with water. The slurry obtained was dried to obtain toner particles having a number average particle size (Dn) of 5.42 μm, a ratio (Dv/Dn) between the volume average particle size (Dv) and number average particle size (Dn) of 1.06 and a variation coefficient of particle size distribution of 16.7%.

After the first Soxhlet exaction with methanol, the proportion of the methanol-soluble resin component was 0.8% by weight. From the results of the succeeding second Soxhlet extraction with THF, the proportion of the THF-soluble resin component was 97.8% by weight. From the measurements of the glass transition points of the THF-soluble resin component and methanol-soluble resin component, it was found that the maximum glass transition point $Tg_1$ of the THF-soluble resin component was 59° C. while the maximum glass transition point $Tg_2$ of the methanol-soluble resin component was 88° C.

The maximum peak in the molecular weight distribution of the THF soluble resin component after the extraction with methanol showed a molecular weight of 18,200 and the resin component contained 0.3% by weight of polymer component with a molecular weight of 200 to 1,000.

A toner with an external additive was prepared by mixing 2 parts of titanium oxide subjected to crushing and having a BET value of 350 $m^2/g$ to 100 parts of toner obtained using a Henshel mixer.

Then, 95% by weight of carrier with a mean particle size of 35 $\mu$m formed by coating a ferrite core with a silicone resin was placed in a plastic bottle together with 5% by weight of the toner, and a two-component developer was prepared by mixing and stirring with a tubular mixer.

An image quality test was carried out by the same method as described in Example 1 using this two-component developer. The results indicated that reproducibility of half-tone images was nearly satisfactory and reproducibility after standing was also good. No agglomeration of the developer after the evaluation was observed.

A fixing test was carried out using an auxiliary fixing device having the same construction as the CLC-500 copier. The fixing initiation temperature was determined to be 142° C. from the results.

COMPARATIVE EXAMPLE 5

By using the same recipe as in Comparative example 4, particles were formed by a TK homomixer at a rotation speed of 9000 rpm for 10 minutes. The slurry was thoroughly mixed by bubbling with nitrogen in the reaction vessel. Polymerization was continued for 12 hours under a nitrogen atmosphere by adjusting the temperature of an oil bath in which the reaction vessel was immersed to 70° C.

After cooling the reaction mixture to room temperature, solid-liquid separation and washing were repeated. Water was used as an washing solvent. This procedure was repeated 3 times. The slurry obtained was dried to obtain toner particles having a number average particle size (Dn) of 6.62 $\mu$m, a ratio (Dv/Dn) between the volume average particle size (Dv) and number average particle size (Dn) of 1.42 and a variation coefficient of particle size distribution of 40.1%.

After the first Soxhlet exaction with methanol, the proportion of the methanol-soluble resin component was 7.9% by weight. From the result of the succeeding second Soxhlet extraction with THF, the proportion of the THF-soluble resin component was 91.0% by weight. From the measurements of the glass transition points of the THF-soluble resin component and methanol-soluble resin component, it was found that the maximum glass transition point $Tg_1$ of the THF-soluble resin component was 58° C. while the maximum glass transition point $Tg_2$ of the methanol-soluble resin component was 46° C.

The maximum peak in the molecular weight distribution of the THF-soluble resin component after the extraction with methanol showed a molecular weight of 20,100 and the resin component contained 5.23% by weight of polymer component with a molecular weight of 200 to 1,000.

A toner with an external additive was prepared by adding a fine powder of titanium by the same method as described in Example 4.

A carrier was added to this toner as described in Example 1 to prepare a two-component developer for evaluation of image quality. In the reproducibility test, development of the expected images was partly missed with further deterioration in reproducibility after standing.

A fixing test was carried out using an auxiliary fixing device having the same construction as that of the CLC-500 copier. From the results, the fixing initiation temperature was 140° C.

EXAMPLE 5

| | |
|---|---|
| Methanol | 270 parts |
| Ethanol | 270 parts |
| Water | 60 parts |
| Vinlyphenol-methylmethacrylate copolymer (vinylphenol unit 80 mol %, weight average molecular weight 43,000) | 80 parts |
| Styrene | 100 parts |
| n-butyl acrylate | 35 parts |
| Metal compound of di-t-butyl salicylic acid | 1 part |
| 2,2'-azobisisobutyronitrile | 7.5 parts |

The above mixture was placed in a 5-liter reaction vessel and the solution was thoroughly mixed by bubbling with nitrogen in the reaction vessel. Polymerization was further continued for 12 hours under a nitrogen atmosphere by adjusting the temperature of an oil bath in which the reaction vessel was immersed to 85° C. The following mixture was prepared:

| | |
|---|---|
| Oil blue | 10 parts |
| Methanol | 45 parts |
| Ethanol | 45 parts |

Then, this mixture was added to the reaction vessel and stirring was continued for 1 hour at 85° C.

After cooling the reaction mixture to room temperature, solid-liquid separation and washing were repeated. A solution prepared by mixing 60% by weight of methanol and 40% by weight of water was used for the washing solution. This procedure was repeated 3 times and the product was finally washed with water. The slurry obtained was dried to obtain toner particles having a number average particle size (Dn) of 2.04 $\mu$m, a ratio (Dv/Dn) between the volume average particle size (Dv) and number average particle size (Dn) of 1.03 and a variation coefficient of particle size distribution of 11.0%.

After the first Soxhlet exaction with methanol, the proportion of the methanol-soluble resin component was 1.0% by weight. From the result of the succeeding second Soxhlet extraction with THF, the proportion of the THF soluble resin component was 95.6% by weight. From the measurements of the glass transition points of the THF-soluble resin component and methanol-soluble resin component, it was found that the maximum glass transition point $Tg_1$ of the THF-soluble resin component was 59° C. while the maximum glass transition point $Tg_2$ of the methanol-soluble resin component was 103° C.

The maximum peak in the molecular weight distribution of the THF-soluble resin component after the extraction with methanol showed a molecular weight of 26,300 and the resin component contained 0.21% by weight of polymer component with a molecular weight of 200 to 1,000.

A toner having an external additive was prepared by mixing 4.5 parts of titanium oxide subjected to crushing and having a BET value of 350 $m^2/g$ to 100 pats of toner obtained using a Henshel mixer.

Then, 91% by weight of carrier with a mean particle size of 35 $\mu$m formed by coating a ferrite core with a silicone resin was placed in a plastic bottle together with 9% by weight of the toner, and a two-component developer was prepared by mixing and stirring with a tubular mixer.

An image quality test was carried out by the same method as described in Example 1 using this two component developer. The result indicated that reproducibility of half-tone images was nearly satisfactory and reproducibility after standing was also good. No coagulation of the developer after the evaluation was observed.

A fixing test was carried out using an auxiliary fixing device having the same construction as the CLC-500 copier. The fixing initiation temperature was determined to be 143° C. from the results.

The physical properties of the toners of each Example and Comparative Example are listed in Table 1 and the results of their evaluation are shown in Table 2.

TABLE 1

| | Dn (m) | Dv/Dn | Variation coefficient particle number distribution (%) | Methanol-soluble resin component (% by weight) | THF-soluble resin component (% by weight) | $Tg_1$ (° C.) | $Tg_2$ (° C.) | Molecular weight distribution: Maximum value | Molecular weight distribution: Component with molecular weight of 200 to 1000 (% by weight) |
|---|---|---|---|---|---|---|---|---|---|
| Example 1 | 4.02 | 1.03 | 13.7 | 0.4 | 95.6 | 54 | 117 | 20100 | 0.50 |
| Example 2 | 4.13 | 1.05 | 15.8 | 1.7 | 95.2 | 53 | 117 | 19500 | 0.60 |
| Example 3 | 4.06 | 1.07 | 17.8 | 3.6 | 92.9 | 54 | 120 | 2030 | 0.90 |
| Comparative example 1 | 4.23 | 1.07 | 17.8 | 0.01 | 98.0 | 57 | 57 | 22000 | 0.05 |
| Comparative example 2 | 4.11 | 1.09 | 23.0 | 7.6 | 89.7 | 57 | 90 | 21500 | 0.90 |
| Comparative example 3 | 3.94 | 1.09 | 22.1 | 6.3 | 91.7 | 55 | 51 | 23500 | 0.80 |
| Comparative example 4 | 4.15 | 1.38 | 36.6 | 10.4 | 88.0 | 59 | 46 | 20600 | 6.51 |
| Example 4 | 5.42 | 1.06 | 16.7 | 0.8 | 97.8 | 59 | 88 | 18200 | 0.30 |
| Comparative example 5 | 6.62 | 1.42 | 40.1 | 7.9 | 91.0 | 58 | 46 | 20100 | 5.23 |
| Example 5 | 2.04 | 1.03 | 11.0 | 1.0 | 95.6 | 59 | 103 | 26300 | 0.21 |

TABLE 2

| | Image density | Half-tone reproductibility *1 | Half-tone reproductibility after standing *1 | Agglomeration *2 | Fixing initiation temperature (° C.) | Frictional charge ($\mu$C/g) |
|---|---|---|---|---|---|---|
| Example 1 | 1.49 | A | A | A | 140 | −32.4 |
| Example 2 | 1.44 | A | A | A | 144 | −32.0 |
| Example 3 | 1.46 | A | A | A | 150 | −31.8 |
| Comparative example 1 | 1.45 | A | D | D | 142 | −30.0 |
| Comparative example 2 | 1.45 | A | B | B | 163 | −33.1 |
| Comparative example 3 | 1.41 | B | E | D | 135 | −30.7 |
| Comparative example 4 | 1.38 | C | E | D | 135 | −36.1 |
| Example 4 | 1.51 | B | B | A | 142 | −25.5 |
| Comparative example 5 | 1.47 | E | E | E | 140 | −24.9 |
| Example 5 | 1.45 | A | A | A | 143 | −40.9 |

*1 Evaluation basis of half-tone images
A: No distortion of dots, very good
B: No scattering, dot configuration is good with a few irregularities
C: Scattering, dot configuration is irregular but no problem
D: Scattering, evident irregularity in dot configuration
E: Developing is missing at portions where dots are expected, severe scattering
*2 Evaluation basis for agglomeration
A: no packing, fluid powder, very good
B: partially packed, fluid powder by shaking, good
C: Packed, fluid powder by shaking, no problem
D: Packed, a little coagulation
E: Coagulation block is not cracked, blocking

What is claimed is:

1. A toner for developing an electrostatic image comprising:

(a) at least 100 parts by weight of a binder resin; and (b) 0.1 to 15 parts by weight of a colorant, wherein said toner has a number average particle size (Dn) of 0.5 to 6.0 μm, a particle size distribution coefficient ratio of volume average particle size (Dv)/number average particle size (Dn) of 1.0 to 1.3 and a variation coefficient of particle number distribution of 20% or less, said toner contains 0.1 to 5.0% by weight of methanol-soluble resin component extracted by a first Soxhlet extraction with methanol and 50 to 99% by weight of THF-soluble resin component extracted by a second Soxhlet extraction with tetrahydrofuran (THF) after the first Soxhlet extraction with methanol, and a highest glass transition point ($Tg_2$) of the methanol-soluble resin component and a maximum glass transition point ($Tg_1$) of the THF soluble resin component satisfying the following equation;

$$0\ (^\circ\ C.) < Tg_2 - Tg_1 \leqq 150\ (^\circ\ C.)$$

and $$50\ (^\circ\ C.) \leqq Tg_1.$$

2. A toner according to claim 1, wherein said toner has a number average particle size (Dn) of 1.0 to 5.0 μm.

3. A toner according to claim 1, wherein said toner has a particle size distribution coefficient (Dv/Dn) of 1.0 to 1.2.

4. A toner according to claim 1, wherein said toner has a variation coefficient of 18% or less.

5. A toner according to claim 1, wherein said toner has a number average particle size (Dn) of 1.0 to 5.0 μm, a particle size distribution coefficient (Dv/Dn) of 1.0 to 1.2 and a variation coefficient of 18% or less.

6. A toner according to claim 1, wherein the tetrahydrofuran (THF)-soluble component of said toner has a weight average molecular weight peak in the molecular weight region of 2,000 to 100,000, and contains 3% by weight or less of a component with a weight-average molecular weight of 200 to 1,000, in the molecular distribution of the THF-soluble component determined by GPC.

7. A toner according to claim 1, wherein the tetrahydrofuran (THF)-soluble component of said toner has a weight-average molecular weight peak in the molecular weight region of 2,000 to 100,000, and contains 1% by weight or less of a component with a weight-average molecular weight of 200 to 1,000, in the molecular distribution of the THF-soluble component determined by GPC.

8. A toner according to claim 1, wherein said toner contains 0.2 to 4.0% by weight of methanol-soluble resin component and 60 to 90% by weight of THF-soluble resin component.

9. A toner according to claim 1, wherein the highest glass transition point ($Tg_2$) of said methanol-soluble resin component and the maximum glass transition point ($Tg_1$) of said THF-soluble resin component satisfies the following relation;

$$20\ (^\circ\ C.) < Tg_2 - Tg_1 < 80\ (^\circ\ C.)$$

and $$50\ (^\circ\ C.) \leqq Tg_1.$$

10. A toner according to claim 1, wherein the highest glass transition point ($Tg_2$) of said methanol-soluble resin component and the maximum glass transition point ($Tg_1$) of said THF-soluble resin component satisfies the following relation;

$$0\ (^\circ\ C.) < Tg_2 - Tg_1 \leqq 150\ (^\circ\ C.)$$

and $$50\ (^\circ\ C.) \leqq Tg_1 \leqq 80\ (^\circ\ C.).$$

11. A toner according to claim 1, wherein the highest glass transition point ($Tg_2$) of said methanol-soluble resin component and the maximum glass transition point ($Tg_1$) of said THF-soluble resin component satisfies the following relation;

$$20\ (^\circ\ C.) < Tg_2 - Tg_1 \leqq 80\ (^\circ\ C.)$$

and $$50\ (^\circ\ C.) \leqq Tg_1 \leqq 80\ (^\circ\ C.).$$

12. A toner according to claim 1, wherein said methanol-soluble resin component contains a resin having polar groups.

13. A toner according to claim 12, wherein said polar group is selected from the group consisting of hydroxyl group, ester group, carboxyl group, amide group, ether group and sulfonic acid group.

14. A toner according to claim 1, wherein said toner includes an external additive.

15. A toner according to claim 14, wherein said external additive is a fine powder selected from the group consisting of silica fine powder, alumina fine powder, and titanium oxide fine powder.

16. A two-component developer comprising toner according to claim 1 mixed with carrier particles.

17. A process for producing a toner comprising the steps of:

(a) dissolving (i) a polymerizable monomer soluble in the polymerization solvent and (ii) a polymer composition soluble in said polymerization solvent, to form a polymerization reaction system, wherein said polymerization solvent comprises a mixed polymerization solvent containing at least water and 30 to 99.9% by weight based on the weight of the polymerization solvent, of methanol, ethanol or a mixture thereof;

(b) polymerizing said polymerizable monomer in said polymerization system to form polymerized particles;

(c) washing the polymerized particles with a washing solvent, wherein said washing solvent comprises a mixed washing solvent containing at least water and at least 30% by weight based on the mixed washing solvent, of saturated alcohols represented by the following formula (1):

$$C_nH_{2n+1}OH \quad (1)$$

wherein n is an integer of 1 to 5; and (d) forming a toner from the washed polymerized particles, wherein said toner comprises at least 100 parts by weight of a binder resin and 0.1 to 15 parts by weight of a colorant, said toner having a number average particle size (Dn) of 0.5 to 6.0 μm, a particle size distribution coefficient ratio of volume average particle size (Dv) /number average particle size (Dn) of 1.0 to 1.3 and a variation coefficient of particle number distribution of 20% or less, said toner contains 0.1 to 5.0% by weight of methanol-soluble resin component extracted by a first Soxhlet extraction with methanol and 50 to 99% by weight of THF-soluble resin component extracted by a second Soxhlet extraction with tetrahydrofuran (THF) after the first Soxhlet extraction with methanol, and a highest glass transition point ($Tg_2$) of the methanol-soluble resin component and a maximum glass transition point ($Tg_1$) of the THF-soluble resin component satisfying the following relation;

$$0\ (^\circ\ C.) < Tg_2 - Tg_1 \leqq 150\ (^\circ\ C.)$$

and $$50\ (^\circ\ C.) \leqq Tg_1.$$

18. A process according to claim 17, wherein said polymer composition contains a polymeric compound selected from the group comprising polyhydroxystyrene, polystyrene sulfonic acid, vinylphenol-acrylic acid ester copolymer, vinylphenol-methacrylic acid ester copolymer, styrene-vinylphenol-acrylic acid ester copolymer, styrene-vinylphenol-methacrylic acid ester copolymer and mixtures thereof.

19. A process according to claim 17, wherein said polymer composition has a weight average molecular weight of 3,000 to 300,000.

20. A process according to claim 17, wherein said mixed polymerization solvent includes 0.1 to 70% by weight of water and 30.0 to 99.9% by weight of methanol, ethanol or a mixture thereof.

21. A process according to claim 17, wherein said mixed polymerization solvent contains an additional organic solvent.

22. A process according to claim 17, wherein said mixed washing solvent comprises 0.1 to 70% by weight of water and 30% by weight or more of said saturated alcohol.

23. A process according to claim 17, wherein said polymerized particles are washed with said washing solvent 1 to 10 times in said washing step (c).

24. A process according to claim 17, wherein said polymerized particles are washed with water after washing with said washing solvent in step (c).

25. A process according to claim 17, wherein the step (d) for forming said toner is conducted by at least one of drying the polymerized particles, classifying the polymerized particles or coloring the polymerized particles.

26. A process according to claim 17, wherein said toner has a number average particle size (Dn) of 1.0 to 5.0 μm.

27. A process according to claim 17, wherein said toner has a particle size distribution coefficient (Dv/Dn) of 1.0 to 1.2.

28. A process according to claim 17, wherein said toner has a variation coefficient of 18% or less.

29. A process according to claim 17, wherein the number average particle size (Dn) of said toner is 1.0 to 5.0 μm, the particle size distribution coefficient (Dv/Dn) of said toner is 1.0 to 1.2 and the variation coefficient of said toner is 18% or less.

30. A process according to claim 17, wherein the tetrahydrofuran (THF)-soluble component of said toner has a weight-average molecular weight peak in the molecular weight region of 2,000 to 100,000 and contains 3% by weight or less of components with a weight-average molecular weight of 200 to 1,000, in the molecular distribution of the THF-soluble component determined by GPC.

31. A process according to claim 17, wherein the tetrahydrofuran (THF)-soluble component of said toner has a weight-average molecular weight peak in the molecular weight region of 2,000 to 100,000 and contains 1% by weight or less of components with a weight-average molecular weight of 200 to 1,000, in the molecular distribution of the THF-soluble component determined by GPC.

32. A process according to claim 17, wherein said toner contains 0.2 to 4.0% by weight of a methanol-soluble resin component and 60 to 90% by weight of a THF-soluble resin component.

33. A process according to claim 17, wherein the highest glass transition point ($Tg_2$) of the methanol-soluble resin component and the maximum glass transition point ($Tg_1$) of the THF-soluble resin component satisfies the following relation;

$$20\ (^\circ\ C.) < Tg_2 - Tg_1 \leqq 80\ (^\circ\ C.)$$

and $$50\ (^\circ\ C.) \leqq Tg_1.$$

34. A process according to claim 17, wherein the highest glass transition point ($Tg_2$) of the methanol-soluble resin component and the maximum glass transition point ($Tg_1$) of the THF soluble resin component satisfies the following relation;

$$0\ (^\circ\ C.) < Tg_2 - Tg_1 \leqq 150\ (^\circ\ C.)$$

and $$50\ (^\circ\ C.) \leqq Tg_1 \leqq 80\ (^\circ\ C.).$$

35. A process according to claim 17, wherein the highest glass transition point ($Tg_2$) of the methanol-soluble resin component and the maximum glass transition point ($Tg_1$) of the THF-soluble resin component satisfies the following relation;

$$20\ (^\circ\ C.) < Tg_2 - Tg_1 \leqq 80\ (^\circ\ C.)$$

and $$50\ (^\circ\ C.) \leqq Tg_1 \leqq 80\ (^\circ\ C.).$$

36. A process according to claim 17, wherein said methanol-soluble resin component contains a resin having polar groups.

37. A process according to claim 36, wherein each said polar group is selected from the group consisting of hydroxyl group, carboxyl group, ester group, amide group, group, and sulfonic acid group.

38. A process according to claim 17, wherein said includes an external additive.

39. A process according to claim 38, wherein said external additive is a fine powder selected from the group consisting of silica fine powder, alumina fine powder, and titanium oxide fine powder.

40. A process according to claim 17, wherein said toner is mixed with carrier particles to form a two-component developer.

* * * * *

UNITED STATES PATENT AND TRADEMARK OFFICE

CERTIFICATE OF CORRECTION

PATENT NO. : 5,985,502

DATED : November 16, 1999

INVENTOR(S) : YASUKAZU AYAKI ET AL.

It is certified that error appears in the above-identified patent and that said Letters Patent is hereby corrected as shown below:

ON THE TITLE PAGE [56] ABSTRACT:

Line 16, "relation;" should read --relation:--.

COLUMN 1:

Line 39, "a" should read --an--; and
Line 45, "become" should read --becomes--.

COLUMN 3:

Line 6, "an" should read --a--;
Line 40, "DRAWING" should read --DRAWINGS--.

COLUMN 5:

Line 1, "an" should read --with a--;
Line 9, "leasr" should read --least--;
Line 54, "is;" should read --is,--; and
Line 60, "(%) (standard" should read
--(%) = (standard--.

COLUMN 9:

Line 17, "-chloroethylvinyl ether" should read
--chloroethylvinyl ether--; and
Line 45, "pentaerythritol dimethacrylate," should read
--pentraerythritol trimethacrylate--.

UNITED STATES PATENT AND TRADEMARK OFFICE

CERTIFICATE OF CORRECTION

PATENT NO. : 5,985,502

DATED : November 16, 1999

INVENTOR(S) : YASUKAZU AYAKI ET AL.

It is certified that error appears in the above-identified patent and that said Letters Patent is hereby corrected as shown below:

COLUMN 10:

Line 58, "I," should read --C.I.--.

COLUMN 11:

Line 58, "kind" should read --kinds--.

COLUMN 12:

Line 23, "a extraction" should read --an extraction--.

COLUMN 15:

Line 49, "the in" should read --in--.

COLUMN 17:

Line 29, "an" should read --a--.

COLUMN 19:

Line 61, "an" should read --a--.

COLUMN 21:

Line 41, "an" should read --a--.

UNITED STATES PATENT AND TRADEMARK OFFICE

CERTIFICATE OF CORRECTION

PATENT NO. : 5,985,502

DATED : November 16, 1999

INVENTOR(S) : YASUKAZU AYAKI ET AL.

It is certified that error appears in the above-identified patent and that said Letters Patent is hereby corrected as shown below:

COLUMN 24:

Table 1, "coefficient" should read --coefficient of--
and "2030" should read --20300--; and
Table 2, "reproductibility" should read
--reproducibility (both occurences)-- and
"E: Coagulation" should read --E: Coagulated--.

COLUMN 29:

Line 3, "group," should read --ether group,--; and
Line 4, "said" should read --said toner--.

Signed and Sealed this

Tenth Day of October, 2000

*Attest:*

Q. TODD DICKINSON

*Attesting Officer*

*Director of Patents and Trademarks*